US011191359B2

(12) United States Patent
Siekmann

(10) Patent No.: US 11,191,359 B2
(45) Date of Patent: Dec. 7, 2021

(54) CABINET

(71) Applicant: Siematic Möbelwerke GmbH & Co. KG, Löhne (DE)

(72) Inventor: Ulrich Wilhelm Siekmann, Löhne (DE)

(73) Assignee: Siematic Möbelwerke GmbH & Co. KG, Löhne (DE)

( * ) Notice: Subject to any disclaimer, the term of this patent is extended or adjusted under 35 U.S.C. 154(b) by 99 days.

(21) Appl. No.: 16/633,355

(22) PCT Filed: Mar. 11, 2019

(86) PCT No.: PCT/EP2019/055944
§ 371 (c)(1),
(2) Date: Jan. 23, 2020

(87) PCT Pub. No.: WO2019/197092
PCT Pub. Date: Oct. 17, 2019

(65) Prior Publication Data

US 2021/0153653 A1 May 27, 2021

(30) Foreign Application Priority Data

Apr. 10, 2018 (DE) ..... 202018101927.9

(51) Int. Cl.
*A47B 96/18* (2006.01)
*A47B 77/08* (2006.01)

(52) U.S. Cl.
CPC ..... *A47B 96/18* (2013.01); *A47B 77/08* (2013.01); *A47B 2220/005* (2013.01); *A47B 2220/0077* (2013.01)

(58) Field of Classification Search
CPC ... A47B 77/08; A47B 95/02; A47B 2095/024; A47B 2095/026; A47B 2220/0047;
(Continued)

(56) References Cited

U.S. PATENT DOCUMENTS 7,845,809 B2 * 12/2010 Busing ..... A47L 15/4257 362/92
2020/0170411 A1 * 6/2020 Volkmann ..... A47B 95/02

FOREIGN PATENT DOCUMENTS

CN 203646770 U 6/2014
DE 202014102179 U1 * 7/2014 ..... F21S 4/28
(Continued)

OTHER PUBLICATIONS

Translated Description CN203646770U, 3 pages (Year: 2014).*
(Continued)

*Primary Examiner* — Andrew M Roersma
(74) *Attorney, Agent, or Firm* — Laurence P. Colton; Smith Tempel Blaha LLC

(57) ABSTRACT

A cabinet having a front part, which closes access to the inner region of the cabinet and is mounted movably relative to the cabinet carcass, and supporting inner or side walls or a side cheek arranged vertically in relation to the floor on which the item of furniture is standing. An access opening is formed between the front part and the side cheek, between the front part and at least one further front part, or between the front part and an upper side, which is formed as a table top. A profile is arranged to the rear of the access opening such that it is impossible to see into the inner region of the cabinet through the access opening, the profile having a first part and a second part, each having a face visible through the access opening, the visible faces arranged such that a shadow gap is formed therebetween.

16 Claims, 6 Drawing Sheets

(58) Field of Classification Search
CPC ..... A47B 2220/005; A47B 2220/0075; A47B 2220/0077; A47B 88/919; F25D 27/00; F25D 27/005; F25D 2327/00; F25D 2327/001
See application file for complete search history.

(56) References Cited

FOREIGN PATENT DOCUMENTS

| | | | | |
|---|---|---|---|---|
| DE | 202015105728 | U1 * | 11/2015 | ..... F21V 33/0012 |
| DE | 202014105067 | U1 * | 1/2016 | ..... F21S 4/28 |
| EP | 1980176 | A1 | 10/2008 | |
| KR | 200457121 | Y1 * | 12/2011 | |

OTHER PUBLICATIONS

Translated Description EP1980176A1, 12 pages (Year: 2008).*
WIPO, International Search Report (in parent application), dated Apr. 12, 2019.

* cited by examiner

CABINET

CROSS REFERENCE TO RELATED APPLICATIONS

This application is the US National Phase of and claims the benefit of and priority on International Application No. PCT/EP2019/055944 having an international filing date of 11 Mar. 2019, which claims priority on German Patent Application No. 20 2018 101 927.9 having a filing date of 10 Apr. 2018.

BACKGROUND OF THE INVENTION

Technical Field

The invention relates to a cabinet having at least one front part which closes the access to an inner region of the cabinet and is mounted movably relative to the cabinet carcass, and also having, in particular supporting, inner walls or side walls or at least one side cheek arranged vertically in relation to the floor on which the item of furniture is standing.

Prior Art

Such items of furniture have been known for some time. Especially in kitchen construction, a whole range of cabinets is used, which are equipped with furniture fronts to create a uniform image. By "cabinet" in the sense of the invention, an item of furniture is understood which has at least one furniture cabinet or a plurality of furniture cabinets.

The furniture fronts must usually be opened in order to make the inner region of the cabinets accessible. The furniture fronts can therefore be part of extensions, drawers or cupboards. For opening furniture fronts it can have handles, for example; alternatively, such cabinets can also operate with handleless variants. For this purpose, an access opening is usually provided next to the narrow side of a furniture front, behind which a visual protection profile is arranged, such that it is impossible to see further into the interior of the furniture.

Usually, this visual protection profile is a C-profile or U-profile, usually made of plastic or metal, so that one can see a flat surface behind the access opening from the outside.

BRIEF SUMMARY OF THE INVENTION

The object of the present invention is to create a cabinet of the type mentioned above, which offers new design possibilities in the area of the handle bar.

This problem is solved by a cabinet having at least one front part which closes the access to an inner region of the cabinet and is mounted movably relative to the cabinet carcass, and also having, in particular supporting, inner walls or side walls or at least one side cheek arranged vertically in relation to the floor on which the item of furniture is standing, wherein i) between the front part and at least one side cheek or ii) between the front part and at least one other front part or iii) between the front part and an upper side that is in particular formed as a table top, an access opening is formed serving to grip at least one front part via one of its narrow sides with the hand of an operator and to enable the front part to make accessible the inner region covered by the front part by moving the front part, wherein the profile behind the access opening is arranged such that it is impossible to see into the inner region of the cabinet through the access opening, characterized in that the profile has a first part and a second part connected thereto or formed in one piece therewith, wherein the first part has a first face visible through the access opening and the second part has a second face visible through the access opening, wherein the two visible faces are arranged relative to one another such that a shadow gap is formed therebetween. Advantageous embodiments are found in the dependent claims.

The cabinet according to the invention has at least one front part closing the access to an inner region of the cabinet and being movably mounted relative to the cabinet carcass. For this purpose, the furniture includes in particular supporting inner walls or side walls or at least one side cheek, arranged vertically in relation to the floor on which the item of furniture is standing.

In this case, an access opening is designed i) between the front part and at least one side cheek;

ii) between the front part and at least one other front part, or iii) between the front part and an upper side formed in particular as a table top.

The access opening serves for gripping the at least one front part via one of its narrow sides with the hand of an operator and to enable the front part to make accessible the inner region covered by the front part by moving the front part. Here, a profile behind the access opening is arranged in such a way that it obscures the view into the inner region of the cabinet through the access opening.

This profile is formed from two parts that are interconnected or formed as a single-piece and, according to the invention, has a first part and a second part that is connected therewith or formed as single-piece. The first part comprises a first face visible through the access opening. The second part has a second face visible through the access opening. The two visible faces are arranged relative to each other in such a way that a shadow gap is formed therebetween.

The profile according to the invention gives the cabinet in the area of the handle bar a completely new optical impression. By creating a shadow gap in this area, the handle bar area is provided with an additional optical depth, which negatively affects the overall impression of the cabinet.

According to an advantageous embodiment, at least one of the visible faces is of a flat design or has at least a flat area. Of course, other forms with curves or radii are also conceivable. Preferably, the shape of the visible faces is adapted to the shape of the rest of the design of the cabinet.

In a preferred embodiment of the present invention, it is provided that both visible faces are angled to each other. A particularly optimal depth in the profile can be generated in this way. For this purpose, it may be particularly provided that the visible faces extend from the longitudinal edge of the profile, obliquely to the center of the profile and obliquely to the back of the cabinet. Thus, the greatest depth is reached in the center of the profile, and the viewer's gaze is directed by the oblique guidance of the visible faces in this deeper area in the direction of the shadow gap formed there.

According to a further special embodiment of the present invention, it may be provided that a visible face has an, in particular free, end portion. This end portion may be formed in such a way that its free narrow side is facing the other visible face. In this embodiment, the narrow side of one visible face runs towards the other visible face and thus forms the shadow gap.

The design of the shadow gap has a whole range of other advantages. Thus, for example, the shadow gap can also be illuminated according to a special embodiment of the present invention. Preferably, this is done from behind, i.e. the light bulb cannot be seen by the viewer from the outside.

According to an advantageous embodiment of the present invention, it is provided that a lighting device, in particular an LED illuminant, is arranged in the access opening opposite the back area of a visible face. Of course, other lighting means can also be used. This lighting device therefore provides a discreet but indirect illumination of the shadow gap, which is perceived by the viewer from the outside as a strip of light.

Another preferred embodiment provides that the one visible face, when seen through the access opening, partially covers the view to the other visible face. By means of this covering, for example, the invisible part of a visible face can be illuminated, for example, by means of the previously described lighting device, so that the resulting light in this area is reflected from the hidden part of the visible face into the gap between the two visible faces. The partial covering also means that it is practically impossible for the viewer to see through the shadow gap into the inner region of the cabinet.

The application possibilities of the profile according to the invention are manifold; they can be processed in different places of the cabinet. This means that parts of the profile can, for example, be used to form a stop for a furniture front. According to a preferred embodiment of the present invention, it is provided that the first part of the profile has a first profile leg delimiting the profile to one side. This profile leg is preferably arranged perpendicular to the closed furniture front and can therefore serve as a lateral delimitation of the profile according to the invention and at this point it can be formed as an extension of an intermediate wall or side cheek.

It may also be provided that the second part of the profile has a second profile leg delimiting the profile to one side.

As already mentioned, the above-mentioned profile leg can also serve to form a stop for the front part. For this purpose, it may be preferably provided that at least one profile leg has a stop profile, on which a front part is attached or can abut. Such a stop profile is preferably formed as a type of rubber lip or rubber seal or at least from a damping material, so that on the one hand the furniture front is protected when closing said furniture front and on the other hand an unnecessary noise development during closing is avoided.

As mentioned above, different applications of the profile according to the invention are conceivable, thus according to a special embodiment of the present invention, it may be provided that the profile is arranged in the corresponding cabinet according to the invention below a cabinet upper side, in particular an upper side, preferably a table top, and extends parallel to the bottom or to the upper side of the cabinet with its main longitudinal extension direction.

The profile can be attached in this embodiment in different ways. A preferred variant is that the inner wall or inner walls of the cabinet has/have a recess in which the profile is accommodated and supported. In the other variant, for example, the profile can be simply placed on the cabinet.

According to another variant of the profile according to the invention, it may be provided that the cabinet has two separated inner walls between which the profile is inserted. These inner walls can also be the respective outer walls of two furniture cabinets positioned adjacent to each other. The profile is preferably arranged at least partially between these two inner walls and at this point it can also preferably be fastened, at least in a form-fitting manner.

In another embodiment of the present invention, it may be provided that the profile is inserted into an intermediate space between an inner wall and a side cheek of the cabinet. Thus, the profile according to the invention is suitable for cabinets with handle bars in the area of the side cheek.

According to a preferred embodiment, the profile extends perpendicular to the upper side of the cabinet with its main longitudinal extension direction in the latter two variants.

BRIEF DESCRIPTION OF THE DRAWINGS

The invention is explained in more detail below on the basis of the embodiments shown in FIGS. 1A to 3B.

DETAILED DESCRIPTION OF PREFERRED EMBODIMENTS

Figure 1B:
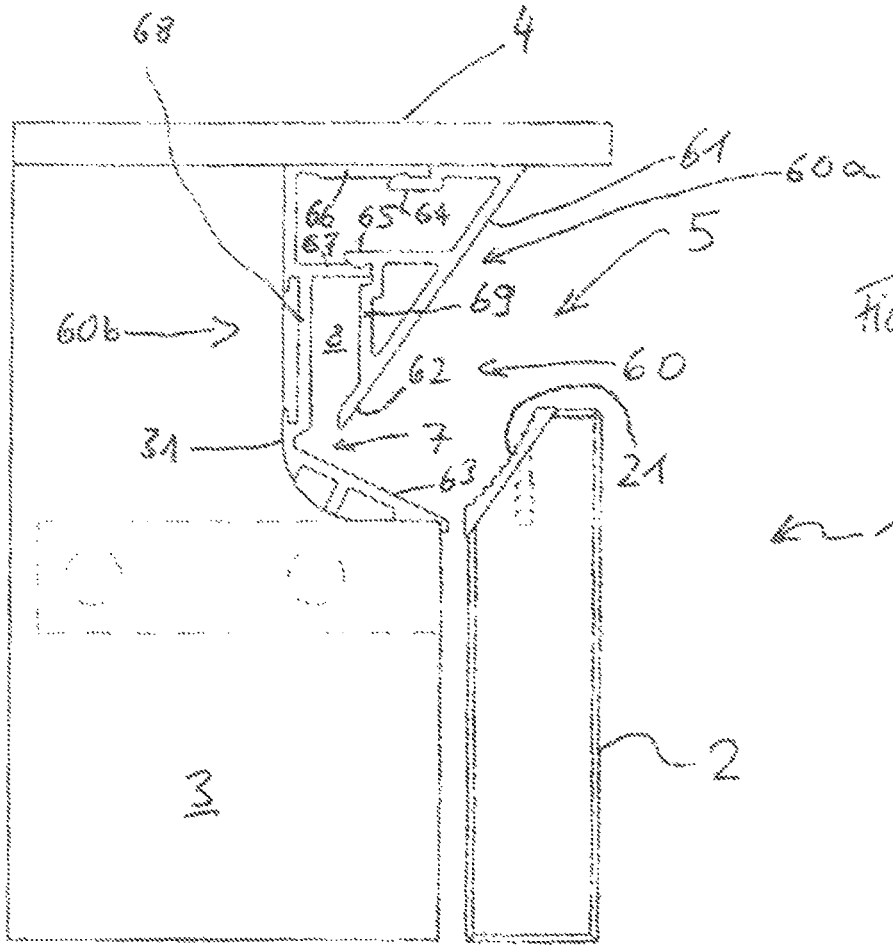
FIG. 1B shows a side view of the view from FIG. 1A.
Figure 1A:
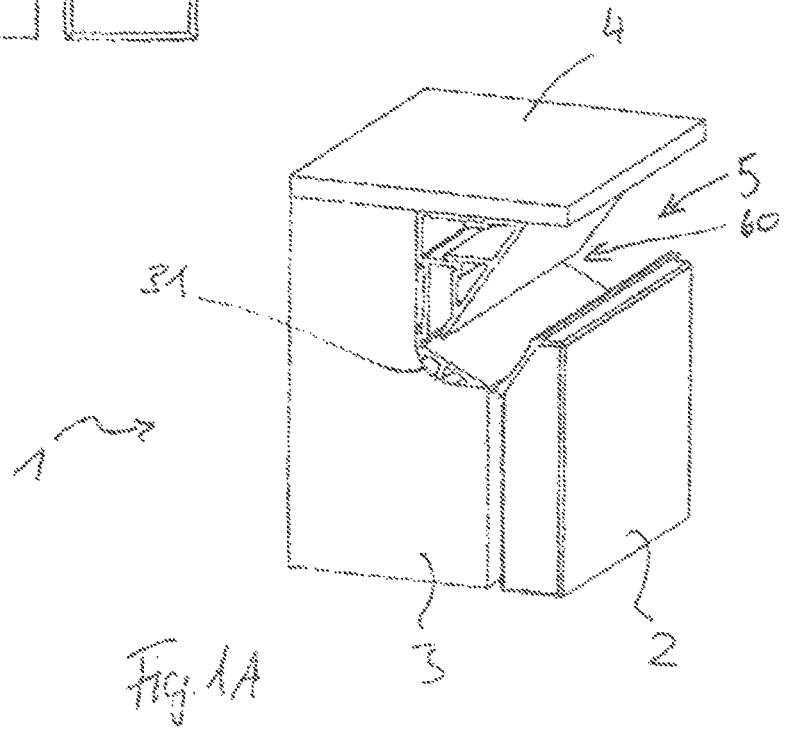
FIG. 1A shows a perspective view on a part of an inventive cabinet according to a first embodiment.

In FIG. 1A, a first embodiment of the present invention is shown based on the example of a kitchen furniture item 1. On the upper side 4, a table top is provided in the example shown. The front of the cabinet is closed to the inner region with a front part 2. Between the table top 4 and the front part 2, an access opening 5 is shown, whose part pointing to the inner region of the furniture is covered by a profile. In the example shown, this profile 60 abuts on a corresponding recess 31 of the inner wall 30.

As can be seen in FIG. 1B, the profile 60 according to the invention is formed as a multi-part profile. It includes a first part 60*a* and a second part 60*b*. The two parts 60*a*, 60*b* are connected to each other, which can be done by a solvable or permanent connection. The two parts can also be formed in one piece. This also applies to all embodiments to be discussed in this description.

In the example shown, the second part 60*b* has horizontally running webs 66, 67 in the drawing, which enter a snap connection with corresponding latching protrusions 64, 65 on the other part 60*a*. Of course, this connection does not have to be according to the type of connection. Any type of connection is also conceivable. At the front of the profile 60*a*, a visible face 61 is arranged, which is visible by the viewer who views the furniture 1 through the access opening 5. The visible face 61 has a free end 62, which is facing the visible face 63 of the other part 60*b* with its narrow side. Between the free end 62 and the visible face 63, a gap 7 is formed, which, in the absence of lighting in the inner region of the furniture 1, is perceived from the outside as a shadow gap. Between the profile 60 and the access opening 5, an access space is formed, which is designed for inserting the hand of a user. In the example shown, the front 2 is still formed with an access portion 21 at its back area facing the access opening, which the user can access in order to be able to open the front, be it a drawer or a flap.

Preferably, the two visible faces 61 and 63 extend at an angle to each other and are angled obliquely to the rear area of the cabinet. In this way, the viewer's gaze is directed to the direction of the gap 7. Behind one part 60*a*, an area 8 surrounded by walls 67, 68 and 69 and covered to the viewing side by the end 62 can be provided. In this area 8, for example, a lighting means can be accommodated in a suitable place, which then illuminates the gap 7 from behind. The lighting means may be provided, for example (but not exclusively) in the form of an LED strip, which is advantageously attached to one of said walls 67, 68 or 69.

Figure 1C:
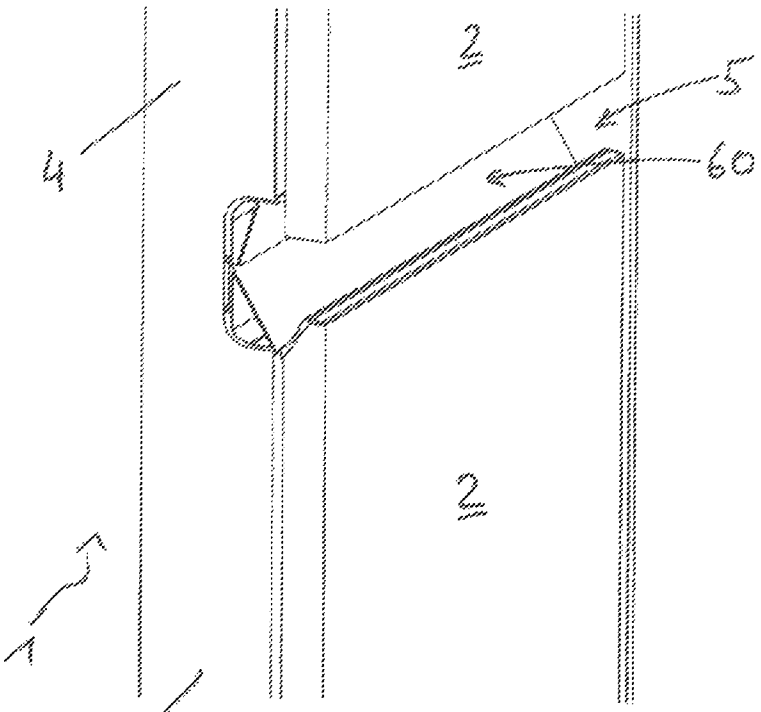
FIG. 1C shows a perspective view of a part of an inventive cabinet according to an alternative of the first embodiment.
Figure 1D:
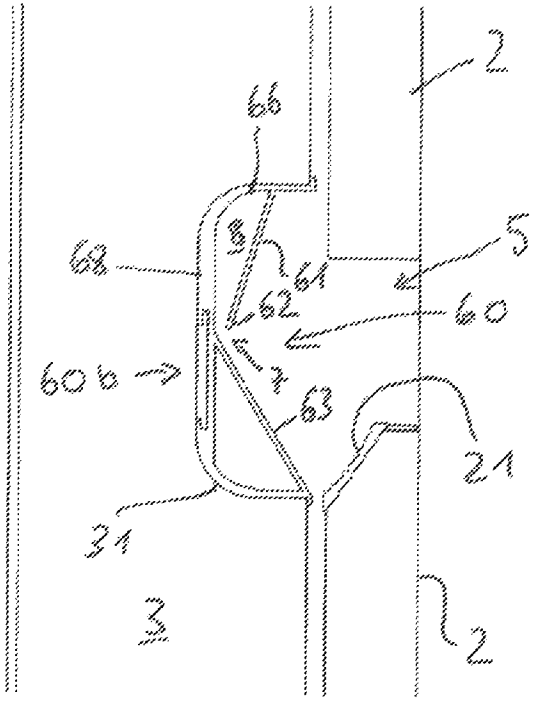
FIG. 1D shows a side view of the view from FIG. 1B.

In FIGS. 1C and 1D, an alternative cabinet of the first embodiment is shown. Instead of the upper side formed as table top, a cabinet top part 4 is provided here, which for example can also have compartments and which is advantageously closed with a front 2. In this embodiment, all features relevant for the profile 60 are the same as above, only that the inner region 3 (shown here) extends over the entire height of the cabinet and the profile 60 is inserted in a corresponding recess 31 or abuts on it.

Figure 2A:
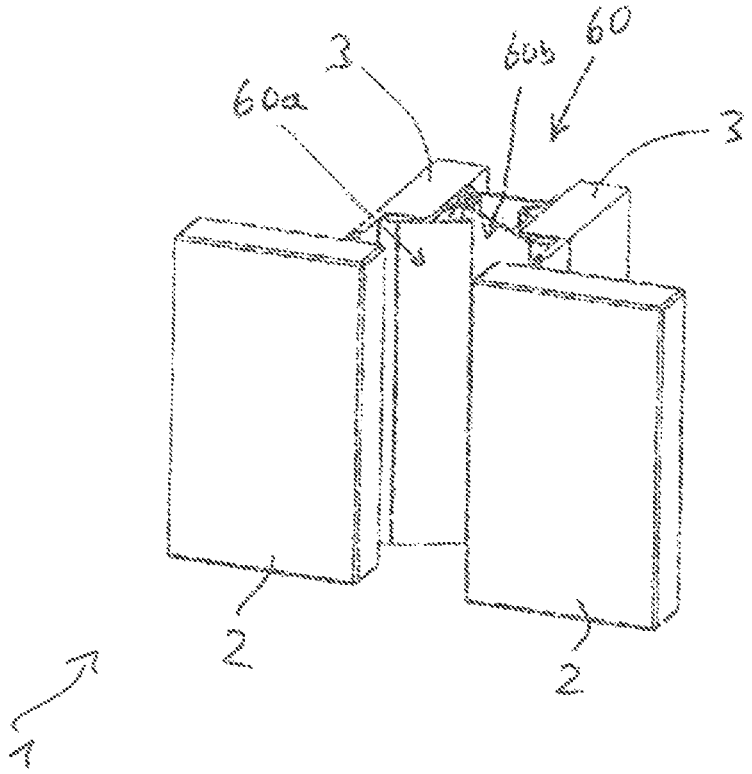
FIG. 2A shows a section of the inventive cabinet according to a second embodiment of the present invention in perspective representation.
Figure 2B:
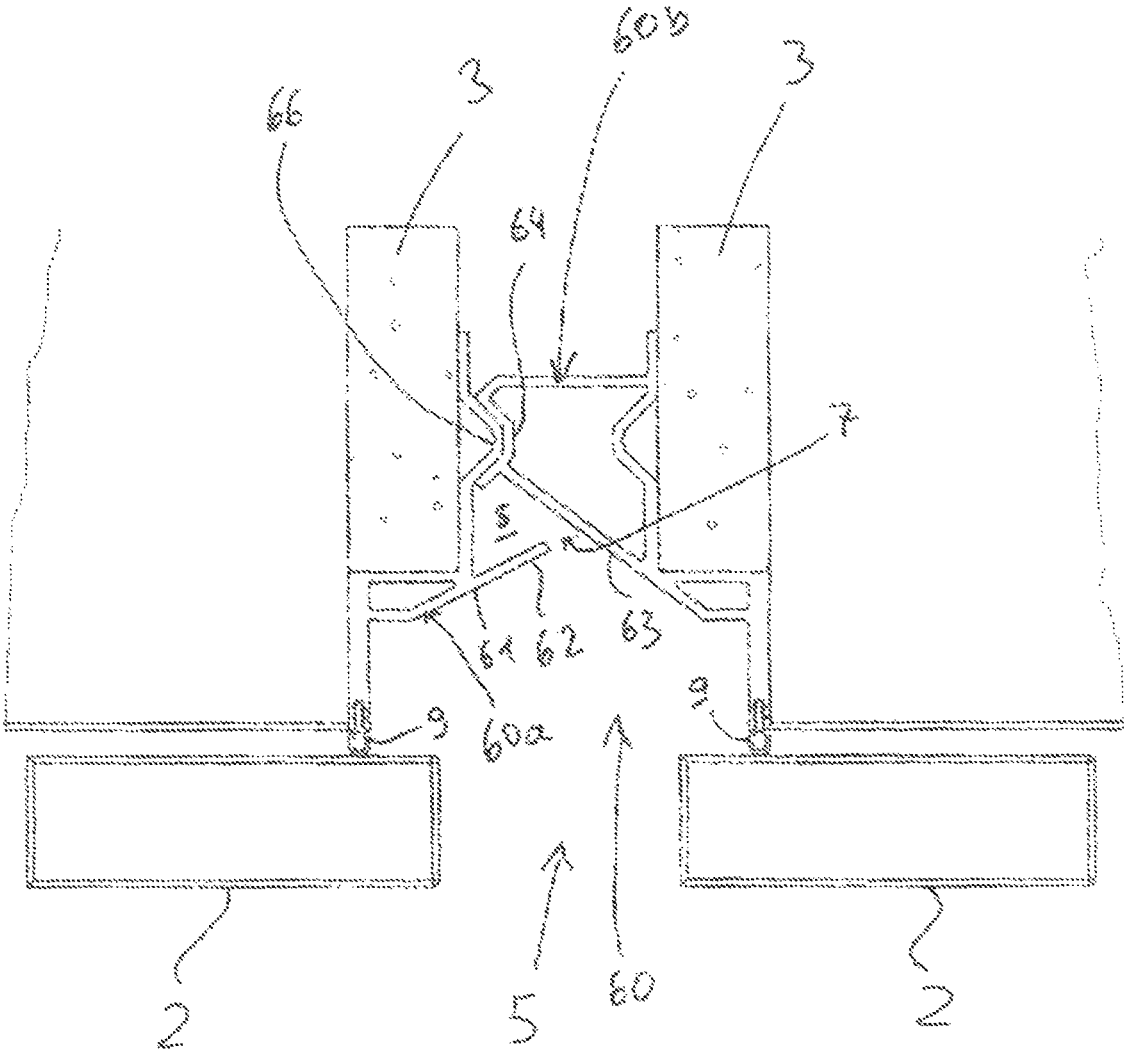
FIG. 2B shows a plan view of the section according to FIG. 2A.

The second embodiment shown in FIGS. 2A and 2B relates in particular to cabinet with a plurality of inner walls 3. The profile 60 according to the invention is introduced in the example shown in the gap area between two inner walls 3 and thus prevents the view into the area between the two inner walls 3. Again, there are the two parts 60*a* and 60*b*, which have the visible faces already described above in connection with the first embodiment.

This is shown in more detail in FIG. 2B. Again, a first visible face 61 shows a free end 62, which points with its narrow side in the direction of the visible face 63 of the other profile part 60*b*. The two profile parts are joined together in the example shown via form-fitting elements 64 and 66 and are inserted between the inner walls 3. The fastening can be done in different ways, whereby the profile parts can be glued or screwed to the inner walls, for example.

In the front part of the profile 60 pointing to the fronts 2, legs are provided, which on the one hand prevent the view into the inner region of the cabinet parts connected to the profile 60, and on the other hand also form a stop for the furniture fronts 2 on both sides of the access opening 5. For this purpose, corresponding stop profiles 9 are preferably provided at the free end of the legs, which have an O-shaped lip in the cross-section in the example shown in the cross-section. Preferably, the profiles 9 are elastic profiles made of rubber or a plastic.

The shown embodiment of the profile according to the invention 60 is therefore suitable in particular for use in the connecting area between two furniture cabinets or two inner walls.

The visible faces 61 and 63 are set in the example shown obliquely to each other and converge in the direction of the profile middle, wherein they extend (seen from the front) starting from the two profile legs obliquely to the rear into the interior of the furniture. In this way, the shadow gap 7 is moved to the rear and an additional depth effect is created by the visible faces 61 and 63 that are obliquely extending to the rear. Of course, here again a lighting means can be arranged in the area 8 behind the visible face 61. For this purpose, reference is accordingly made to the above embodiments.

Figure 3A:
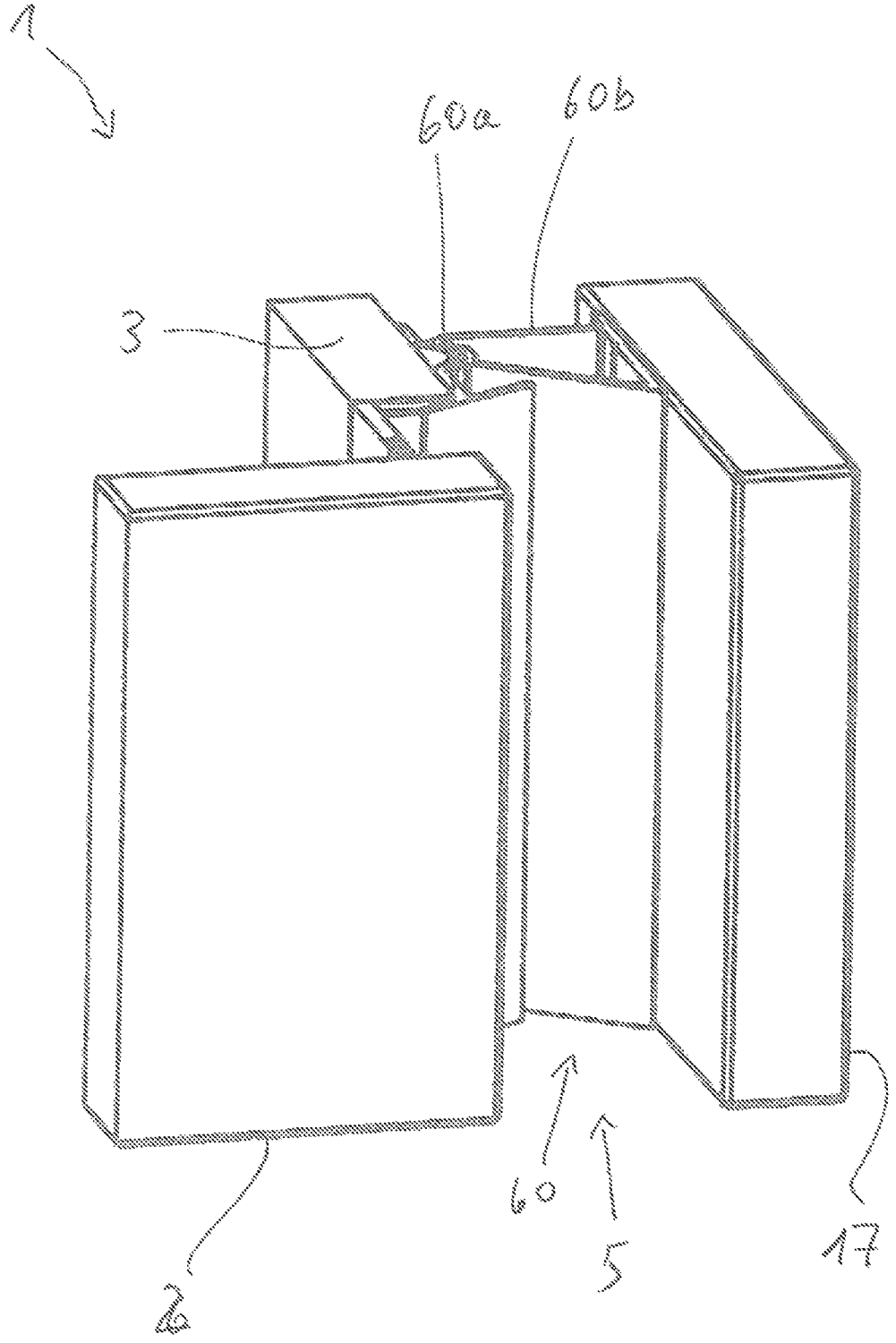
FIG. 3A shows a section of an inventive cabinet according to a third embodiment of the present invention in perspective representation.
Figure 3B:
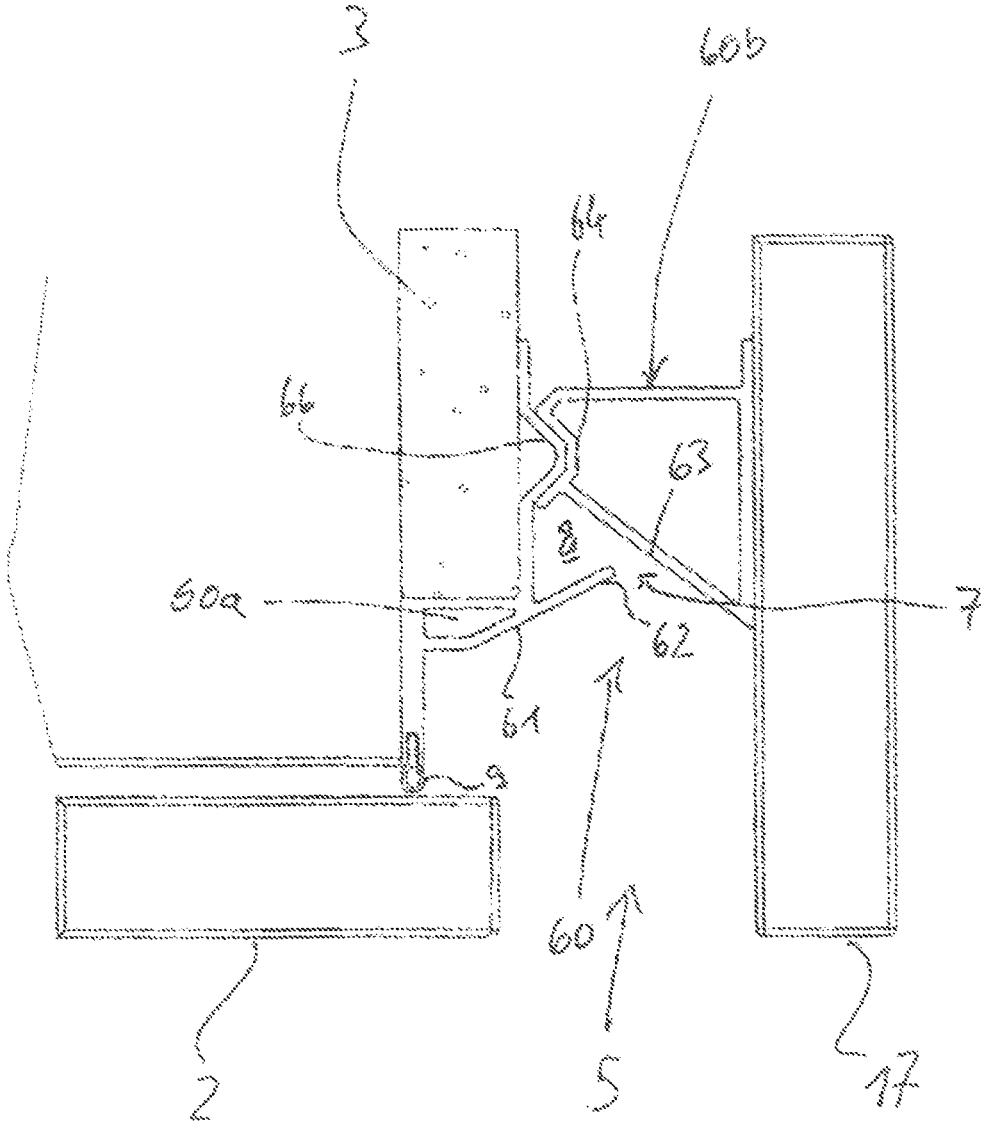
FIG. 3B shows a plan view of the section according to FIG. 3A.

In the edge area of cabinets, a profile 60 according to the invention can also be used and also achieves a depth effect there. Here, in the example of FIGS. 3A and 3B, the profile of the invention 60 is arranged in the area between an inner wall 3 and an outer side cheek 17. Here, too, the two profile parts 60*a* and 60*b* are joined together via joining faces 64 and 66. For the individual fastening options, reference is also made to the above embodiments. In the example shown, one recognizes again the two visible faces 61 and 63, the free end 62 and the space arranged behind the free end 8, which again can also be illuminated in this example with lighting means. The profile part 60*a* has a leg, which can be provided with a corresponding stop profile 9 in the same way previously described.

The three embodiments of the present invention, which are represented in FIGS. 1A to 3B, can also be combined with each other on a cabinet.

The invention claimed is:

1. A cabinet (1) having at least one front part (2) which closes access to an inner region of the cabinet and is mounted movably relative to a cabinet carcass, and also having, in particular supporting, inner walls (3) or side walls or at least one side cheek (17) arranged vertically in relation to a floor on which the cabinet is standing, wherein i) between the at least one front part (2) and the at least one side cheek (17), or ii) between the at least one front part (2) and at least one other front part (2), or iii) between the at least one front part (2) and an upper side (4) that is formed as a table top, an access opening (5) is formed serving to grip the at least one front part (2) via a narrow side thereof with a hand of an operator and to enable the at least one front part (2) to make accessible the inner region of the cabinet by moving the at least front part (2), wherein a profile (60) behind the access opening (5) is arranged such that it is impossible to see into the inner region of the cabinet (1) through the access opening (5), wherein the profile (60) has a first part (60*a*) and a second part (60*b*) connected thereto or formed in one piece therewith, wherein the first part (60*a*) has a first face (61) visible through the access opening (5) and the second part (60*b*) has a second face (63) visible through the access opening (5), wherein the first and second visible faces (61, 63) are arranged relative to one another such that a shadow gap (7) is formed therebetween, wherein both of the first and second visible faces (61, 63) are angled to each other, and wherein the first and second visible faces (61, 63) extend obliquely towards a center of the profile (60) and obliquely towards a back of the cabinet (1) starting from a longitudinal edge of the profile.

2. The cabinet (1) according to claim 1, wherein at least one of the first and second visible faces (61, 63) is of a flat design or has a flat area.

3. The cabinet (1) according to claim 1, wherein the first visible face (61) has an end portion (62).

4. The cabinet (1) according to claim 3, wherein a free narrow side of the end portion (62) of the first visible face (61) is facing the second face (63).

5. The cabinet (1) according to claim 1, wherein in a rear area of the first face (61) opposite the access opening (5) an LED lighting is arranged.

6. The cabinet (1) according to claim 1, wherein the first face (61), seen through the access opening (5), partially covers a view to the second face (63).

7. The cabinet (1) according to claim 1, wherein the first part (60*a*) of the profile (60) has a first profile leg delimiting the profile to one side.

8. The cabinet (1) according to claim 1, wherein the second part (60*b*) of the profile (60) has a second profile leg delimiting the profile (60) to one side.

9. The cabinet (1) according to claim 7,
wherein the first profile leg has a stop profile (9) on which the at least one front part (2) is attached or can abut.

10. The cabinet (1) according to claim 1,
wherein the profile (60) is arranged below a cabinet upper side (4) in particular of an upper side (4), and extends parallel to a bottom or to a top of the cabinet upper side (4) with a main longitudinal extension direction thereof.

11. The cabinet (1) according to claim 10,
wherein the inner walls (3) or side walls thereof has/have a recess (31) in which the profile (60) is absorbed and supported.

12. The cabinet (1) according to claim 1, comprising
two of the inner walls (3) that are at a distance from each other, between which the profile (60) is inserted.

13. The cabinet (1) according to claim 1,
wherein the profile (60) is inserted into an intermediate space between one of the inner wall (3) and one of the at least one side cheek (17) of the cabinet (1).

14. The cabinet (1) according to claim 12,
wherein the profile (60) extends perpendicular to the upper side (4) with a main longitudinal extension direction.

15. The cabinet (1) according to claim 8,
wherein the second profile leg has a stop profile (9) on which the at least one front part (2) is attached or can abut.

16. The cabinet (1) according to claim 13,
wherein the profile (60) extends perpendicular to the upper side (4) with a main longitudinal extension direction.

* * * * *